US011644216B1

(12) United States Patent
Perez et al.

(10) Patent No.: US 11,644,216 B1
(45) Date of Patent: May 9, 2023

(54) DYNAMIC REGISTER SYSTEM WITH AN ADAPTER MEMBER FOR OSCILLATING AIR VENTS

(71) Applicants: Juan Yuniesqui Perez, Miami, FL (US); Yusbel Perez, Miami, FL (US)

(72) Inventors: Juan Yuniesqui Perez, Miami, FL (US); Yusbel Perez, Miami, FL (US)

( * ) Notice: Subject to any disclaimer, the term of this patent is extended or adjusted under 35 U.S.C. 154(b) by 83 days.

(21) Appl. No.: 17/163,984

(22) Filed: Feb. 1, 2021

(51) Int. Cl.
*F24F 13/14* (2006.01)
*F24F 7/06* (2006.01)
*F24F 13/15* (2006.01)

(52) U.S. Cl.
CPC ..... *F24F 13/1426* (2013.01); *F24F 7/065* (2013.01); *F24F 13/1486* (2013.01); *F24F 13/15* (2013.01); *F24F 2013/1446* (2013.01)

(58) Field of Classification Search
CPC .... F24F 2013/1446; F24F 13/15; F24F 7/065; F24F 2013/1426; F24F 13/1486; F24F 13/075; F24F 13/142; F24F 13/1426; F24F 11/89; F24F 2013/1473; F24F 2013/205; F04D 25/105; B60H 1/3414; B60H 1/3421
See application file for complete search history.

(56) References Cited

U.S. PATENT DOCUMENTS 2,417,303 A 3/1947 Jordan
6,929,525 B2 * 8/2005 Lee ..... F04D 29/005 446/217
2019/0128559 A1 * 5/2019 Zhou
2019/0351744 A1 * 11/2019 Kim

FOREIGN PATENT DOCUMENTS

CN 108592271 A * 9/2018
CN 209229970 U * 8/2019 ..... B60H 1/3421
GB 881806 A * 11/1961
JP 2013233872 A * 11/2013
KR 101178187 B1 * 9/2012

OTHER PUBLICATIONS

English Translation of CN-209229970-U dated Jun. 13, 2022 (Year: 2022).*
English Translation of KR101178187B1 dated Jun. 13, 2022 (Year: 2022).*
English Translation of CN-108592271-A dated Jun. 13, 2022 (Year: 2022).*
English Translation of JP2013233872A dated Oct. 13, 2022 (Year: 2022).*

* cited by examiner

*Primary Examiner* — Edelmira Bosques
*Assistant Examiner* — Brett Peterson Mallon
(74) *Attorney, Agent, or Firm* — Sanchelima & Associates, P.A.; Christian Sanchelima; Jesus Sanchelima

(57) ABSTRACT

A dynamic register system automatically adjusts venting panels attached to an air vent in order to evenly disperse the air supplied by the vent in a room. The dynamic register system includes a fan internally mounted within the air vent. The air supplied by the air vent causes the fan to turn providing the system with mechanical energy. The fan is then attached to a gear system which in turn is attached to an adapter. The gear system then translates the rotational mechanical energy of the fan into an oscillating motion for the adapter. The adapter is then mounted to an axle which engages with the venting panels attached to the vent. As the adapter oscillates the axle is adjusted which in turn adjusts the venting panels periodically to evenly distribute air.

11 Claims, 11 Drawing Sheets

DYNAMIC REGISTER SYSTEM WITH AN ADAPTER MEMBER FOR OSCILLATING AIR VENTS

BACKGROUND OF THE INVENTION

1. Field of the Invention

The present invention relates to a dynamic register system and, more particularly, to a dynamic register system that includes an adapter member coupled to an axle which engages with venting panels to provide an oscillating motion to the vents.

2. Description of the Related Art

Several designs for a dynamic register system have been designed in the past. None of them, however, include a dynamic register system including a rotor assembly, a vent assembly, and a housing assembly. The rotor assembly includes fan blades which are coupled to a gear system. The fan blades provide mechanical energy to the gear system as the fan blades spin. The vent assembly is couped to the gear system and includes an adapter arm. The adapter arm oscillates as a result of the turning of the gear system. Additionally, the vent assembly includes vents with lateral support structures coupled together with an axle. The adapter member engages with the axle which in turn allows for the oscillation of the vents. It is known that there is a need to efficiently distribute the airflow provided by an air vent in a given room. It is also known that traditional air vents and or registers are provided in a static system which direct air flow only in a prepositioned direction. This static system does not allow the air flow to be properly and evenly distributed throughout a room. Therefore, there is a need for a dynamic system without the need of electrical power which enables oscillating air vents to evenly and efficiently distribute air flow in a room.

Applicant believes that a related reference corresponds to U.S. Pat. No. 6,929,525 issued for a swinging decorative attachment comprising a base having at least one rack and one boring allowing airflow through the base. Applicant believes that another related reference corresponds to U.S. Pat. No. 2,417,303 issued for an electric fan with a housing for the working parts of an oscillating mechanism. However, the cited references differ from the present invention because they fail to disclose a rotor assembly which is coupled to a vent assembly for oscillating vents without the need of electrical power thereby distributing air flow evenly and efficiently in a room. The vent assembly includes an adapter member coupled to an axle which engages fan vents. The adapter member is in communication with a gear system which provides mechanical energy and rotates the adapter member. The present invention advantageously allows air flow to be evenly distributed in a room without the need for electrical power.

Other documents describing the closest subject matter provide for a number of more or less complicated features that fail to solve the problem in an efficient and economical way. None of these patents suggest the features of the present invention.

SUMMARY OF THE INVENTION

It is one of the objects of the present invention to provide a dynamic register system which features oscillating air vents in order to evenly and efficiently distribute air flow in a given room.

It is another object of this invention to provide a dynamic register system which oscillates air vents without the need of external power. The energy from the air flow within an air duct used to oscillate an adapter member which in turn oscillates the air vents.

It is still another object of the present invention to provide a dynamic register system which is easily and efficiently implemented by enclosing the system within a housing that is mounted to an air duct.

It is still another object of the present invention to provide a dynamic register system which maintains comfortable air flow within a room environment by evenly distributing air being supplied to the room.

It is still another object of the present invention to provide a dynamic register system which can be easily installed onto existing air ducts.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
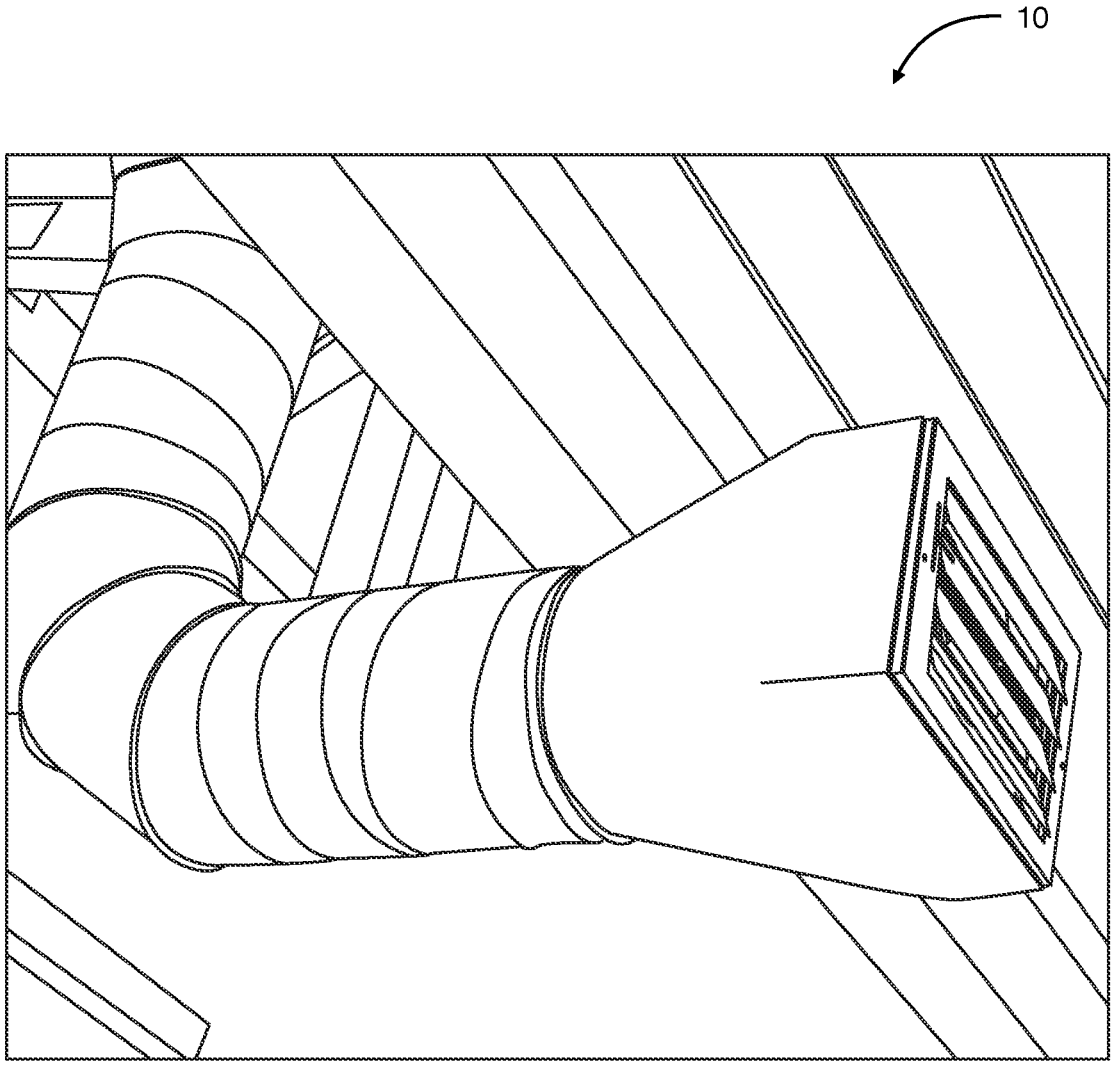
FIG. 1 represents an operational isometric view of dynamic register system 10 mounted to an air duct in accordance with an embodiment of the present invention.

Referring now to the drawings, where the present invention is generally referred to with numeral 10, it can be observed a dynamic register system 10 that basically includes a rotor assembly 20, a vent assembly 40, and a housing assembly 60.

Rotor assembly 20 is effectively depicted in FIGS. 5-8 of the provided drawings. In the present embodiment, rotor assembly 20 is a means for providing an oscillating motion. Rotor assembly 20 includes a fan blade 21. As observed in FIG. 6, fan blades 21 may include blade portions that each meet at a center. The present invention may feature any number of blade portions which may be adjusted in order to configure the efficiency of the system 10. In one implementation, fan blades 21 may be made of a metal or plastic material. It should be understood that other embodiments of the present invention may feature fan blades of varying shape and materials. Fan blade 21 engages a shaft 22 at the center. Further, shaft 22 is communicably coupled with a pedestal 24 with bushings 23.

Pedestal 24 may be provided as a rectangular portion or any other shape for the portion and may have four outwardly protruding arms. The rectangular portion includes an opening in the center which receives shaft 22 having fan blade 21 mounted thereon. In the present embodiment, a bushing 23 is inserted onto the shaft 22 and positioned between the fan blade 21 and the pedestal 24. Once inserted therethrough, another bushing 23 is inserted to the portion of the shaft 22 which protrudes from the rectangular portion of the pedestal. The present implementation features four protruding arms from the rectangular portion which are used to couple the pedestal 24 to housing assembly 60. The four protruding arms may be provided as metal or plastic arms which protrude outwardly from each of the four corners of the rectangular portion. It should be understood that additional embodiments could feature any number of arms with any shape protruding from pedestal 24. Additionally, each of the protruding arms includes a mounting member on a distal most end which is used to communicably engage with the housing assembly 60. Other implementations may feature additional protruding arms for the pedestal 24.

Figure 16:
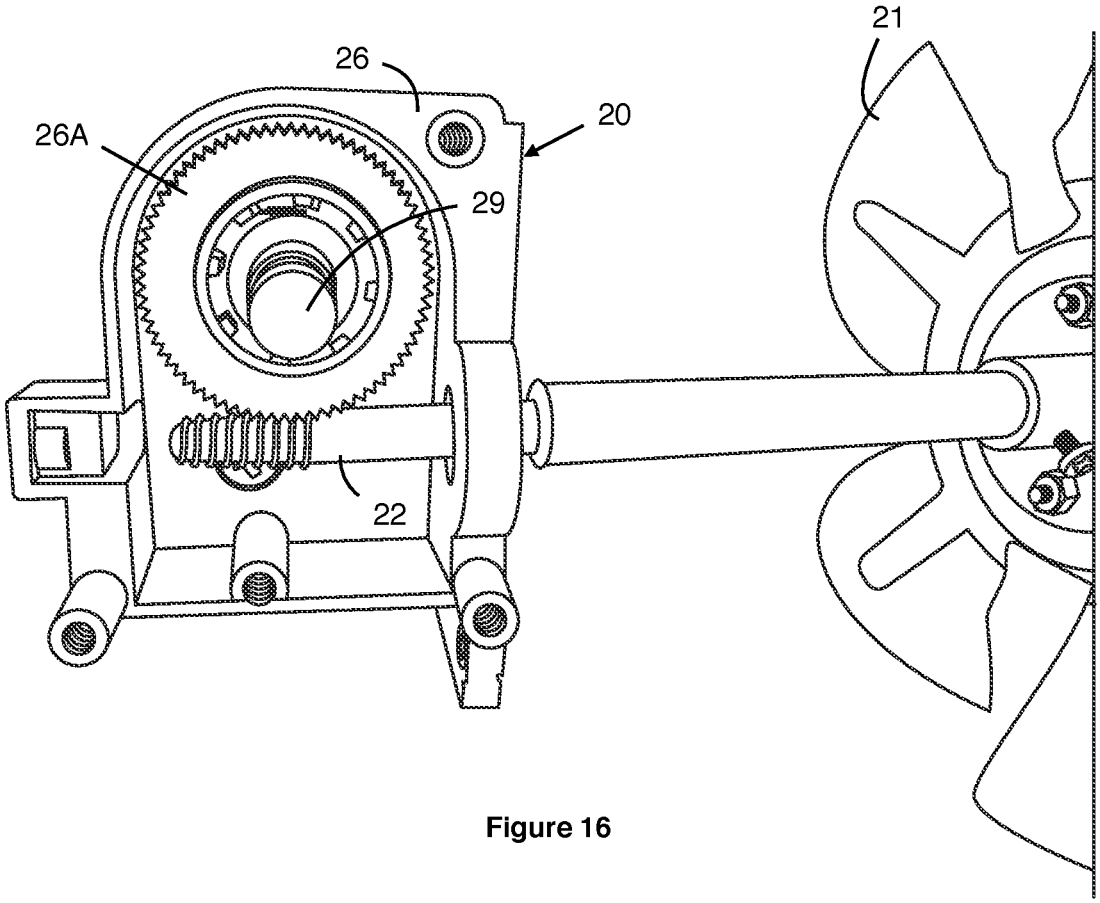
FIG. 16 is an internal front view of casing 26 depicting a worm wheel 26A engaging with shaft 22 in accordance with an embodiment of the present invention.
Figure 17:
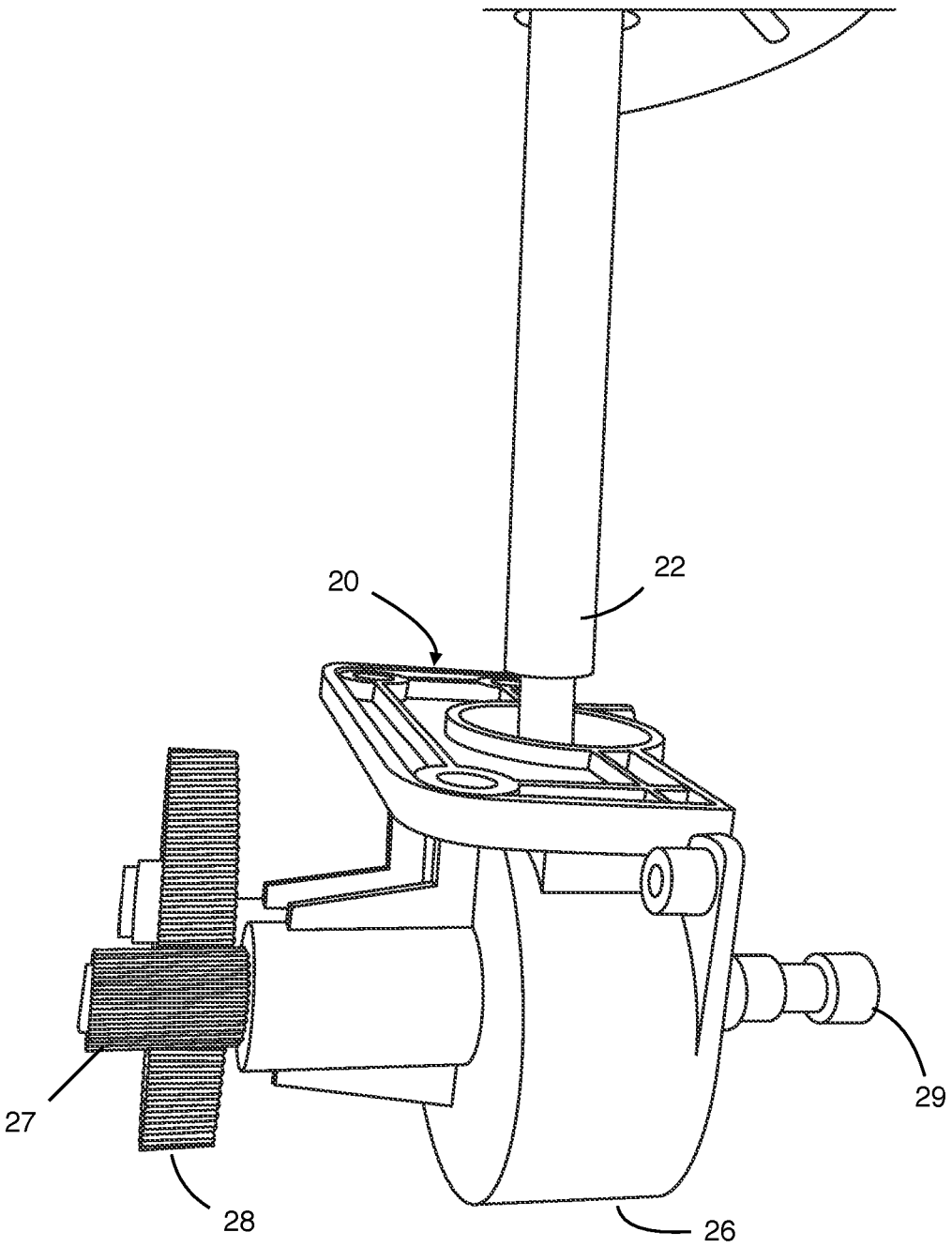
FIG. 17 is an isometric top view of casing 26 depicting a configuration of the first gear 27 and second gear 28 in accordance with an embodiment of the present invention.

Rotor assembly 20 further includes a casing 26 which is coupled with a first gear 27 and a second gear 28. In one embodiment, the casing 26 may be provided as being made of a metal or plastic material. Casing 26 houses a worm wheel 26A which engages with shaft 22 that has fan blade 21 mounted thereon. In one embodiment, shaft 22 is a worm shaft which includes endless threading toward a distal end of the shaft 22 which engages with worm wheel 26A in order to form a worm gear. This configuration can properly be observed in FIG. 16 of the provided drawings. The distal end with the endless threading of the shaft 22 which protrudes outwardly from the opening of the rectangular portion of the pedestal 24 is inserted through the casing 26. Further, bushing 23 is operatively positioned between the pedestal 24 and the casing 26. First gear 27 is communicably coupled to the worm gear which is then operatively connected to a second gear 28 to form a gear system having a predetermined gear ratio. Furthermore, first gear 27 may be further include a splined shaft 29 protruding perpendicularly therefrom. In the present embodiment, splined shaft 29 is an optional feature which may be installed to enable a braking assembly onto the dynamic register system 10. It should be understood that configuration of the gear system requires at least two gears and more gears could be added in order to achieve a desired oscillation.

Rotor assembly 20 further includes a handle 25 and a cam 25A which are communicably engaged to the second gear 28 of the gear system. In the present embodiment, handle 25 is mounted to an outer portion of the casing 26. Cam 25A is positioned between the handle 25 and the casing 26. The present configuration allows for the handle 25 to turn in an oscillating motion when the dynamic register system is inserted into an existing air duct. The fan blades 21 receive a moving force in the form of the existing air that is being supplied through the air duct. As the air passes through, the fan blades 21 are then caused to rotate. The rotation of the fan blades 21 also results in the rotation of the shaft 22 which is then being operatively engaged to the gear system located on casing 26. The resulting rotation of the gear system further results in the oscillating motion of the handle 25 which is operatively mounted to the second gear 28. The described structure enables the oscillating motion without the need for an external power source being coupled to the gear system or the fan blades. It is advantageously enabled by using the force of the air supplied by an existing air duct.

Figure 9:
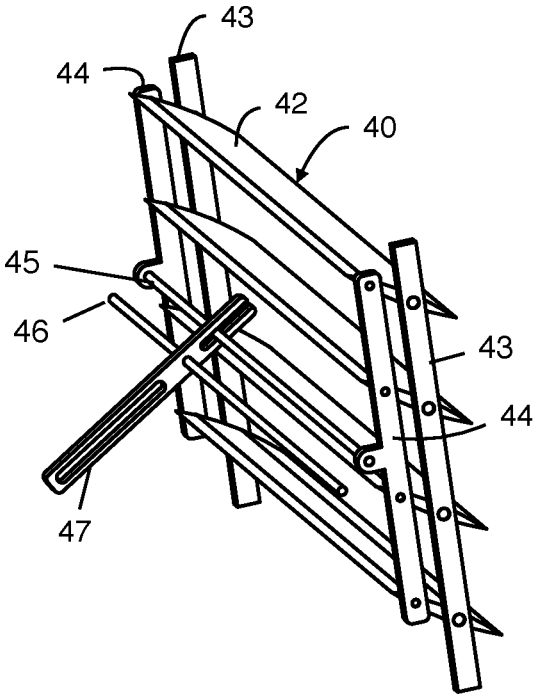
FIG. 9 illustrates an isometric view of vent assembly 40 in accordance to an embodiment of the present invention.
Figure 10:
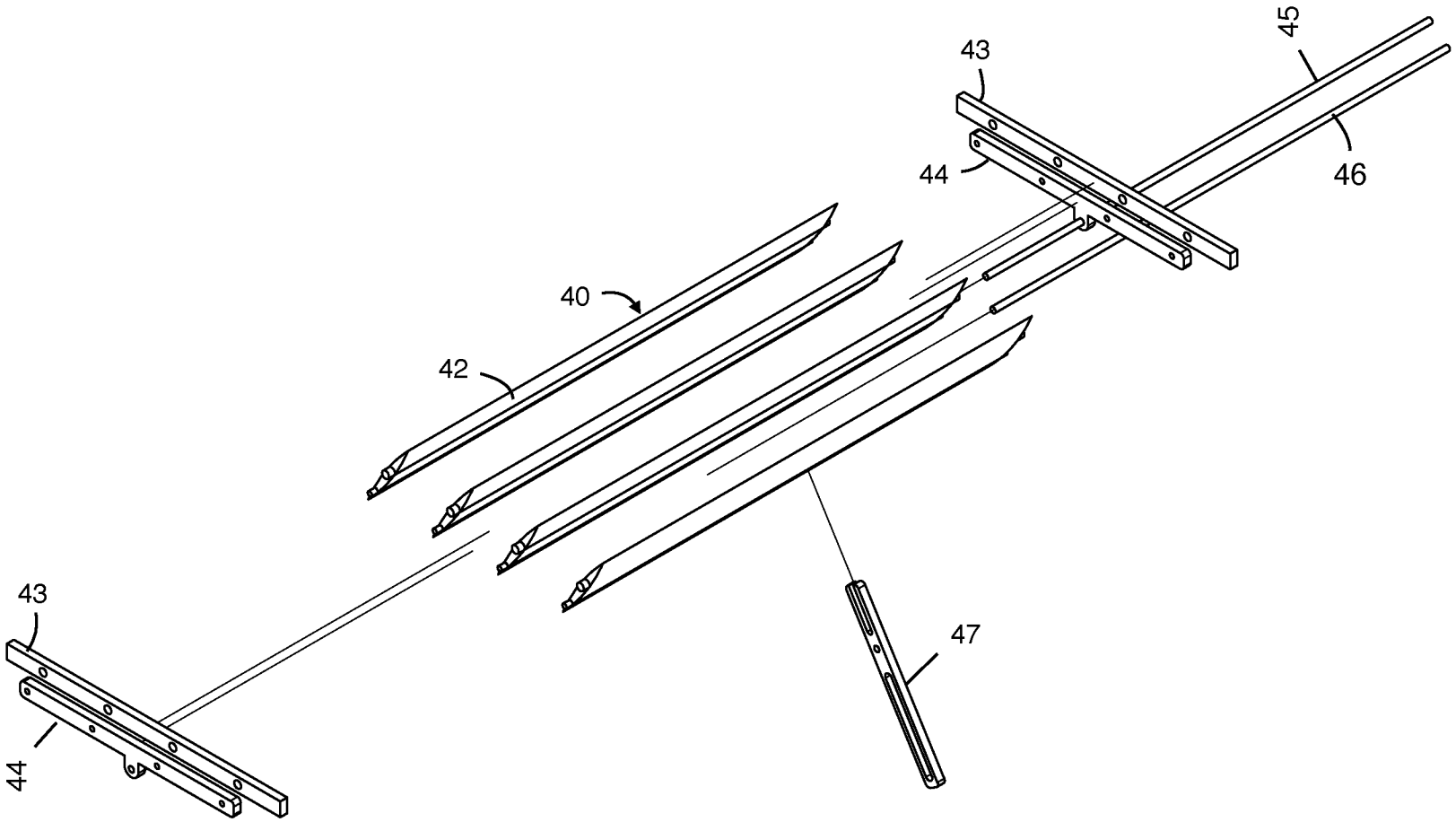
FIG. 10 is a representation of an exploded view of vent assembly 40 in accordance with an embodiment of the present invention.

Vent assembly 40 is effectively depicted in FIGS. 9 and 10 of the provided drawings. In the present embodiment, vent assembly 40 is a means for evenly distributing air being supplied through an air duct. Vent assembly 40 is operatively connected to the rotor assembly 20. Vent assembly 40 includes a plurality of venting panels 42. In the present implementation, four venting panels 42 are provided each having a substantially rectangular structure. It should be understood that any number of venting panels 42 may be implemented into the system 10. Some embodiments may feature 3 or 5 or more venting panels 42. Further venting panels 42 may vary in shape and is not limited to having a rectangular structure.

Vent assembly 40 further includes a guide ruler 43 and a mobility ruler 44. Guide ruler 43 and mobility ruler 44 engage venting panels 42 along the lateral sides. In one embodiment, venting panels 42 includes protrusion members which are lined along the lateral side ends thereof. Additionally, both guide ruler 43 and mobility ruler 44 includes apertures which correspondingly receive the protrusion members from venting panels 42. Other embodiments of the present invention may feature other means for coupling guide ruler 43 and mobility ruler 44 to venting panels 42. In the present embodiment, guide ruler 43 is provided as an elongated rectangular member. Guide ruler 43 is a stationary ruler which remains coupled to the venting panels 42 and remains stationary when the venting panels 42 are in their oscillating state. It should be understood that venting panels 42 are rotatably coupled to the guide ruler 43 and mobility ruler 44. That is that venting panels 42 are rotatable along their connection point to guide ruler 43 to enable rotation thereof. In the present embodiment, mobility ruler 44 is simultaneously coupled to venting panels 42.

Figure 14:
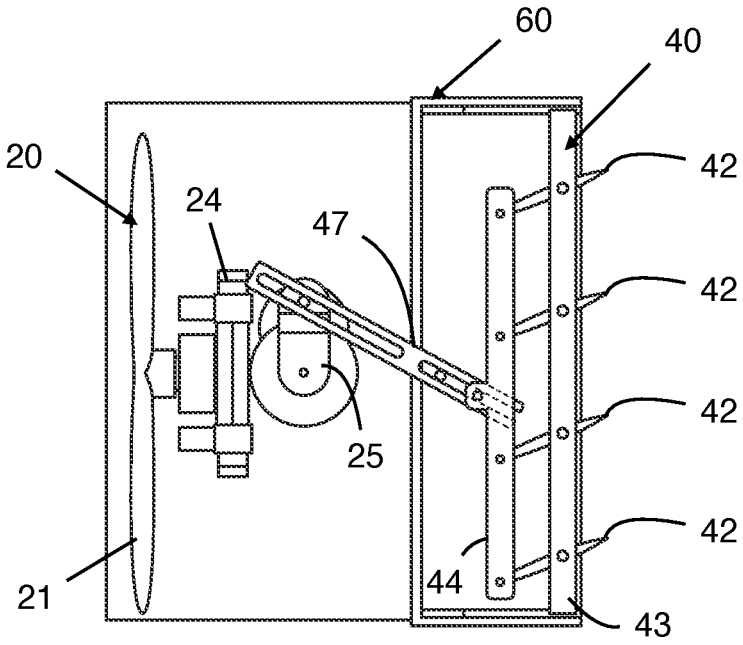
FIG. 14 is a side view of dynamic register system 10 showing the vents oscillating in an upward direction in accordance with an embodiment of the present invention.
Figure 15:
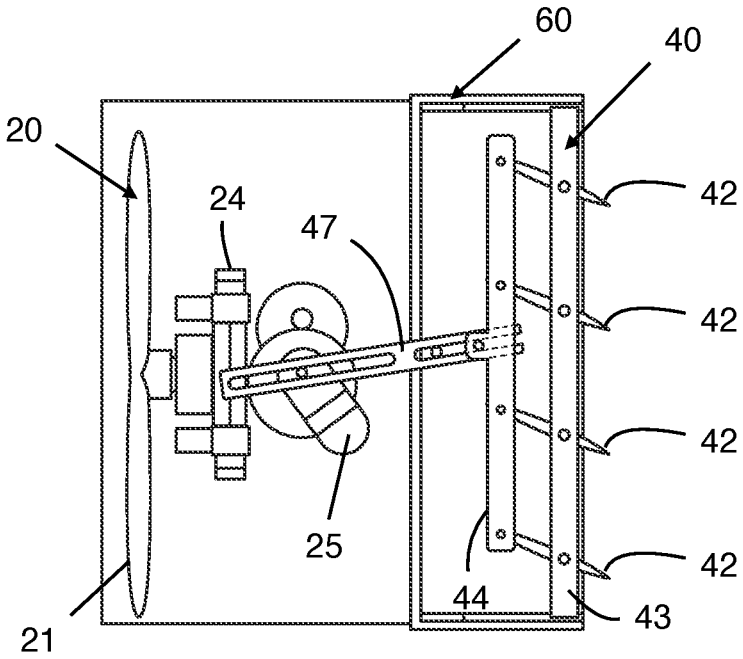
FIG. 15 is another side view of dynamic register system 10 showing the vents oscillating in a downward direction in accordance with an embodiment of the present invention.

Mobility ruler 44 is an elongated rectangular member which may have a height that is less than a height that is provided for guide ruler 43. Additionally, mobility ruler 44 also includes an axle mounting portion which will support an axle to be mounted thereon. This axle mounting portion may be provided as a circular protrusion with an opening from a lateral side edge of mobility ruler 44. In the present embodiment, mobility ruler 44 is a non-stationary ruler which moves up and down along a vertical axis. As mobility ruler 44 moves up and down, the direction of venting panels 42 are adjusted. This configuration is properly observed in FIGS. 14 and 15 of the provided drawings. It can be seen that as mobility ruler 44 moves downwardly, venting panels 42 are directed at an upward angle. Further, it is also observed that as mobility ruler 44 moves upwardly, venting panels 42 are directed in a downward angle. Additionally, it is observed that guide ruler 44 remains stationary as this motion is performed.

Rotor assembly 40 also includes a first axle 45, a second axle 46, and an adapter member 47. In one embodiment, first axle 45 as coupled to mobility rulers 44 which are engaged to venting panels 42. First axle 45 is received by the axle mounting portion of mobility ruler 44. In the present implementation, first axle 45 could be a cylindrical elongated rod member which is positioned perpendicularly to the upright position of mobility rulers 44. Adapter member 47 includes a slit portion, a forked portion, and an axle receiving section. In one embodiment, the slit portion is an elongated opening along the distal operative end of adapter member 47. The slit portion is then operatively connected and engaged with handle 25 of rotor assembly 20 thereby establishing an operative connection between both rotor assembly 20 and vent assembly 40. Additionally, the forked portion is located on the proximal end of adapter member 47. In the present embodiment, the forked portion serves as a slot which operatively engages with first axle 45. Further, second axle 46 is then fed through the axle receiving section of adapter member 47. Second axle 46 may also be provided as an elongated cylindrical rod member. As a result, both first axle 45 and second axle 46 are engaged to adapter member 47. In the engaged configuration, first axle 45 and second axle 46 are positioned as being substantially parallel to each other. In the present embodiment, adapter member 47 serves as the structure which facilities the up and down motion of motility ruler 44 to then adjust the direction of venting panels 42.

Figure 4:
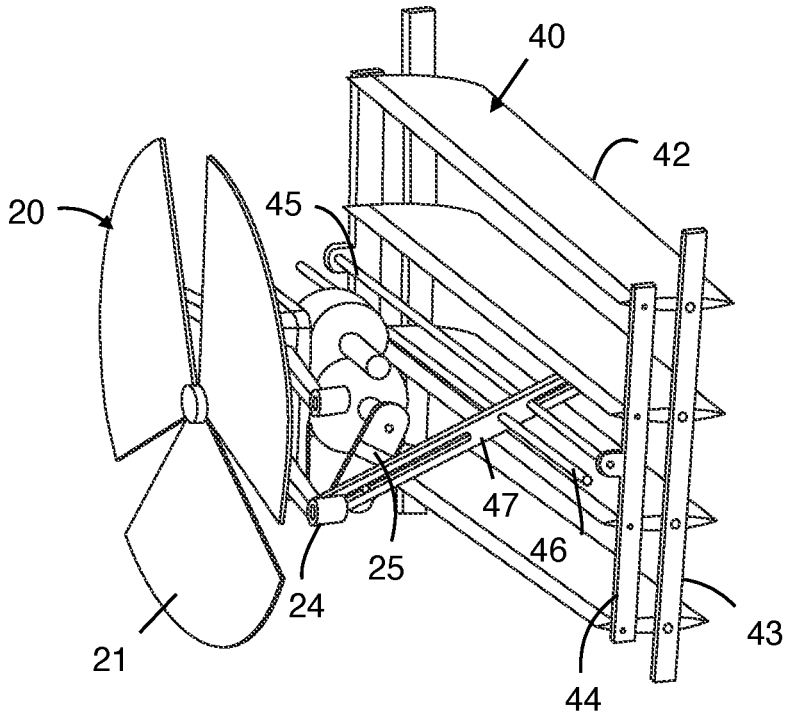
FIG. 4 is a representation of an isometric view of rotor assembly 20 communicably engaging with vent assembly 40 in accordance with an embodiment of the present invention.
Figure 5:
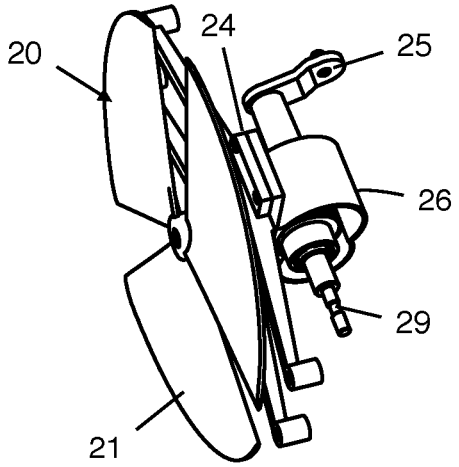
FIG. 5 shows an isometric view of rotor assembly 20 in accordance with an embodiment of the present invention.
Figure 6:
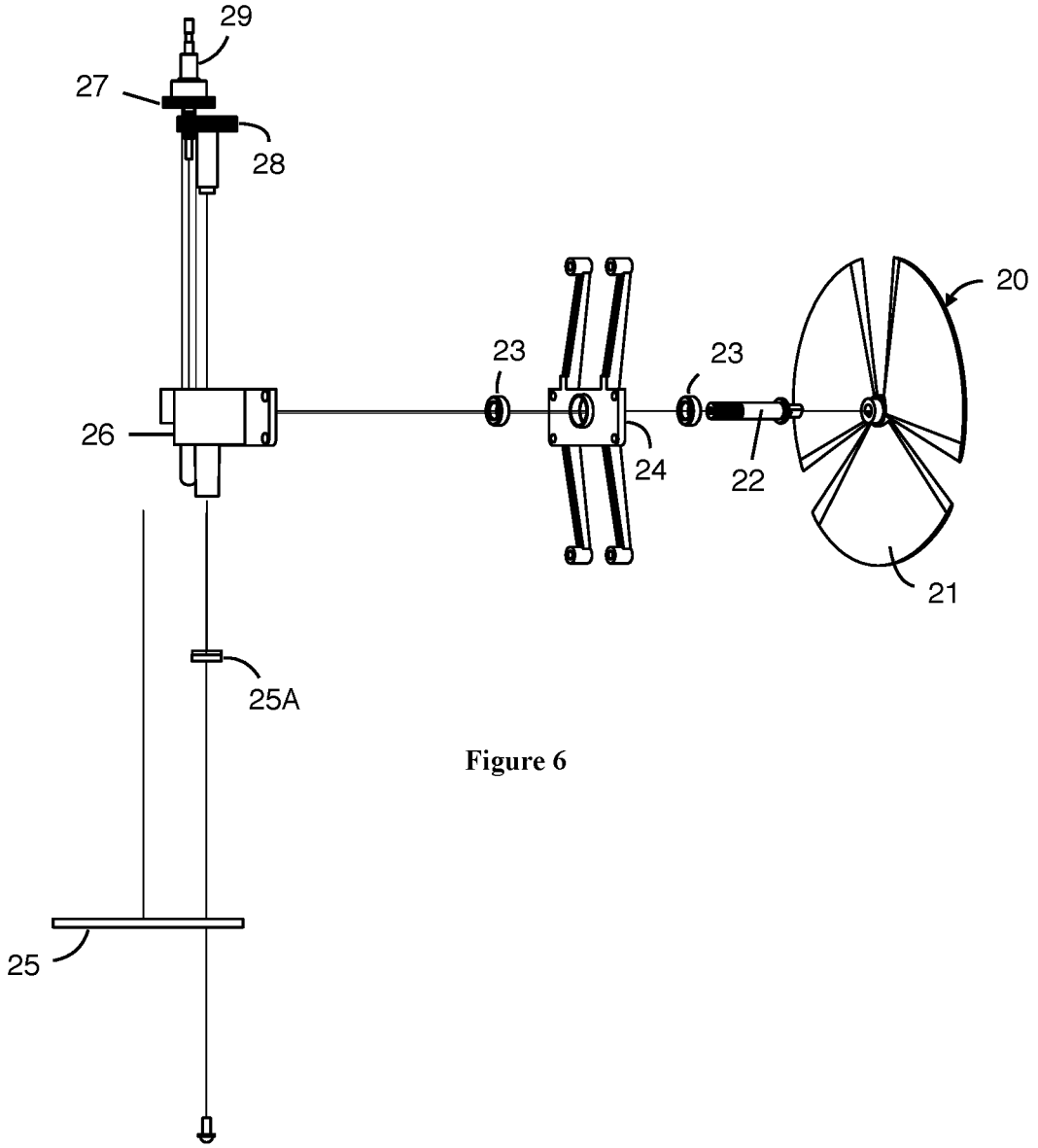
FIG. 6 illustrates an exploded view of rotor assembly 20 in accordance with an embodiment of the present invention.
Figure 7:
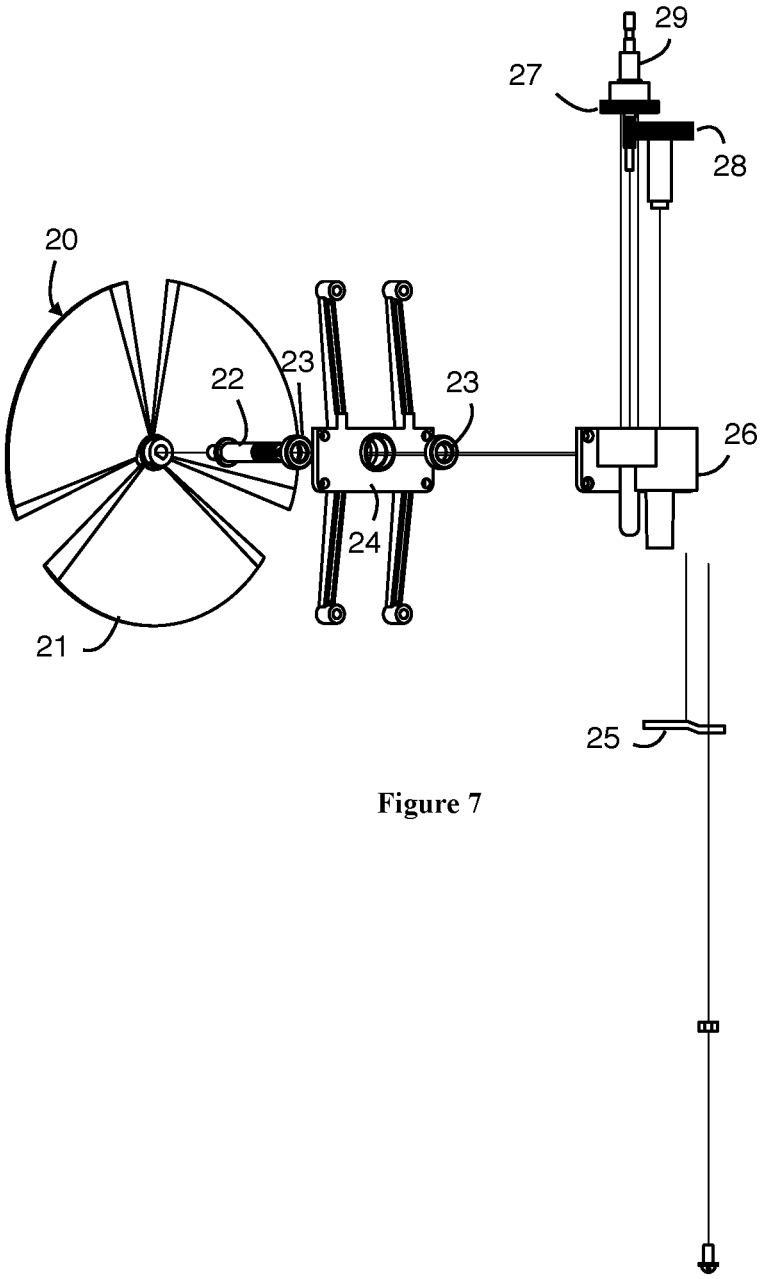
FIG. 7 represents another exploded view of rotor assembly 20 in accordance with an embodiment of the present invention.
Figure 8:
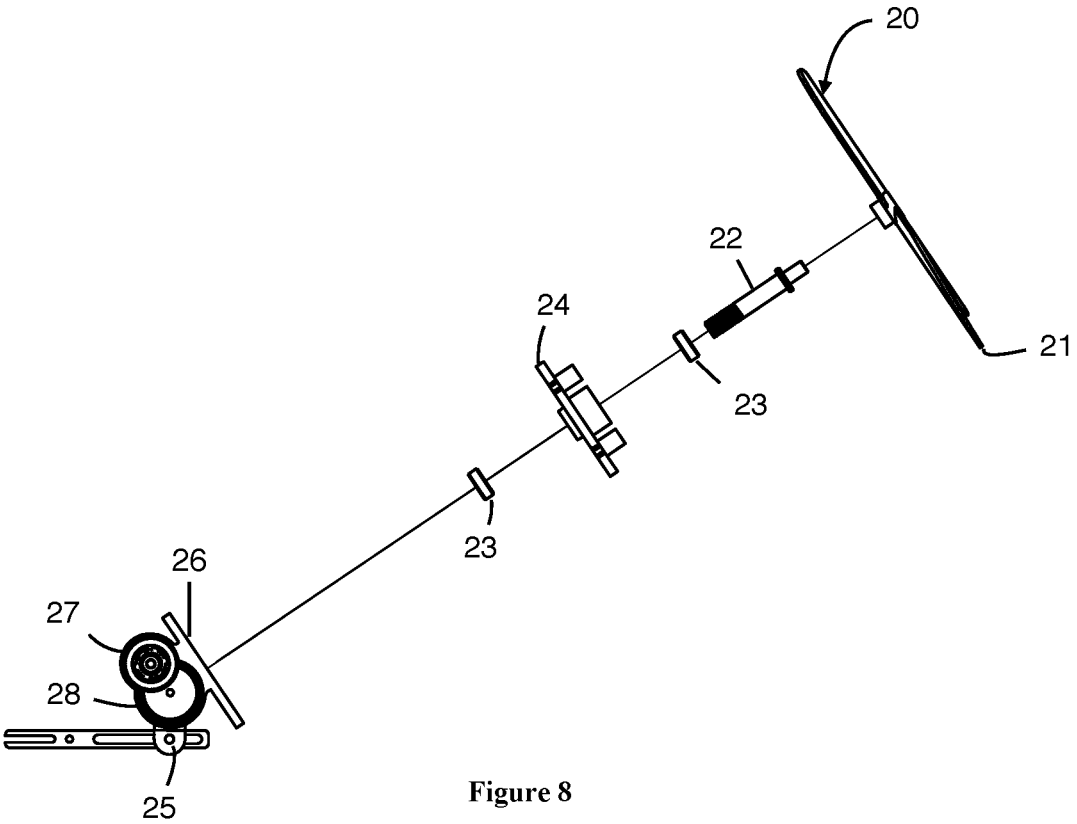
FIG. 8 shows yet another exploded view of rotor assembly 20 in accordance with an embodiment of the present invention.

FIG. 4 depicts rotor assembly 20 and vent assembly 40 both being operatively connected. As observed, adapter member 47 is coupled to handle 25 of rotor assembly 20. Fan blades 21 receive air flow and begin to spin thereby enabling handle 25 to have an oscillating motion as previously described. The oscillating motion of handle 25 is then transferred to adapter member 47. As handle 25 turns, adapter member 47 is then pivoted upwardly and downwardly in a repeated oscillating motion. As adapter member 47 pivots, it then actuates mobility ruler 44 to oscillate in an upward and downward motion due to its connection with first axle 45. Vent panels 42 are then periodically adjusted as mobility ruler 44 oscillates. This configuration may be observed in FIGS. 14 and 15 of the provided drawings. It is observed that the rotation of handle 25 periodically adjusts vent panels 42. This results in the air flow that travels through the system being evenly distributed in a given room. As long as air flow is maintained, venting panels 42 will continue oscillating and dispersing air in a corresponding direction. In the present embodiment, handle 25 is an optional structural element to help transfer the rotational motion of the gears to adapter member 27. In another embodiment, adapter member 47 may be directly coupled to second gear 28 thereby omitting handle 25 to receive rotational oscillating motion. In this embodiment, the oscillating motion of adapter member 47 is delivered directly from second gear 28.

Figure 2:
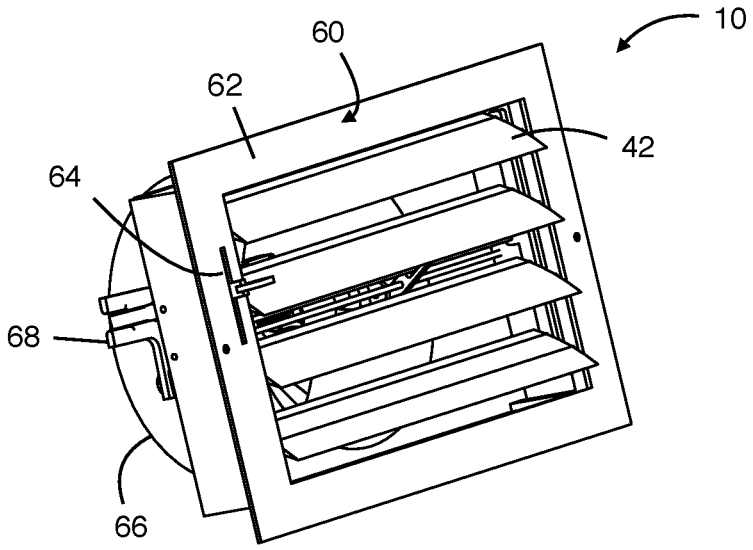
FIG. 2 shows a front isometric view of the assembled dynamic register system 10 in accordance to an embodiment of the present invention.
Figure 11:
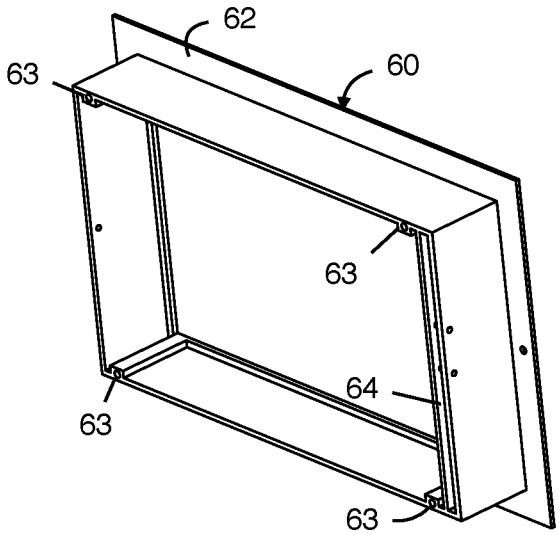
FIG. 11 shows an isometric rear view of a frame portion of housing assembly 60 in accordance to an embodiment of the present invention.
Figure 12:
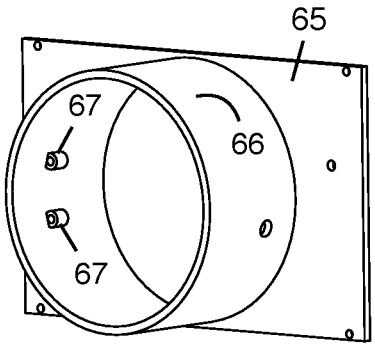
FIG. 12 illustrates an isometric rear view of a back portion of housing assembly 60 in accordance with an embodiment of the present invention.
Figure 13:
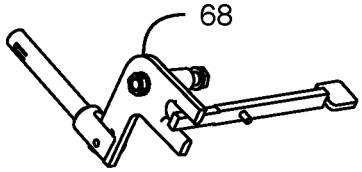
FIG. 13 represents an isometric view of a brake assembly in accordance to an embodiment of the present invention.

Housing assembly 60 includes a frame portion 62 and a back portion 65 which are observed in FIGS. 11 and 12 of the provided drawings. In the present embodiment, housing assembly 60 is a means for mounting rotor assembly 20 and vent assembly 40 to an air duct. Frame portion 62 may be provided as a rectangular frame as observed in the drawings. However, it should be understood that other shapes may be used for frame portion 62. In one implementation, frame portion 62 includes apertures 63 which are configured to receive screw members which could then be used to couple back portion 65 to the frame portion 62. In one embodiment, apertures 63 are positioned along four corner ends of a back end of the frame portion 62. It should be understood that other forms of mounting means may be implemented into the present system. Further, frame portion 62 should have dimensions suitable to receive vent assembly 40 therein. As observed in FIG. 2, vent assembly 40 is mounted to frame portion 62 and expose venting panels 42 from a front end. In one implementation, vent assembly 40 may further include a slit 64 which may be located along a longitudinal side edge of the frame portion 62. Slit 64 is an elongated opening which extends from the front of frame portion 62 to the back of the frame. In one embodiment, slit 64 may be used to implement an optional brake mechanism 68 onto the system.

Figure 3:
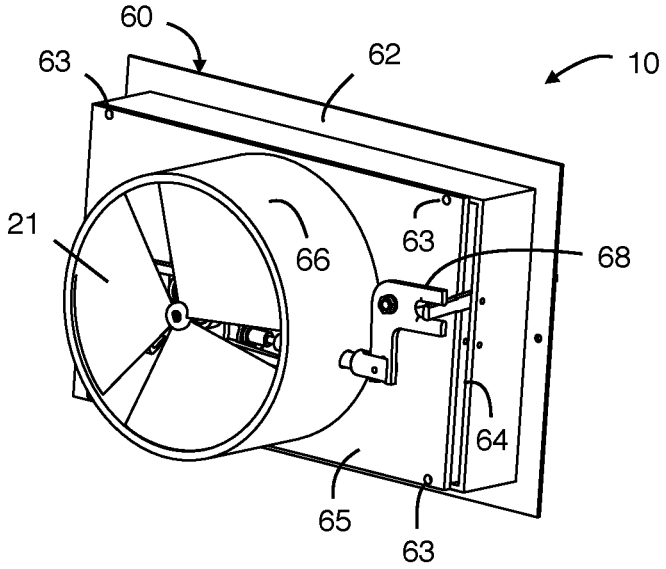
FIG. 3 illustrates a rear isometric view of the assembled dynamic register system 10 in accordance to an embodiment of the present invention.

Back portion 65 includes a shape which corresponds to the shape of frame portion 62. In one embodiment, back portion 65 further includes a blade housing 66 which extends outwardly therefrom. Blade housing 66 may be a cylindrical housing structure which suitably receives fan blades 21 therein. FIG. 3 depicts fan blades 21 being held within blade housing 66. Back portion 65 may also include apertures 63 which receive screws to effectively couple both the frame portion 62 and back portion 65 to nest rotor assembly 20 and vent assembly 40 therebetween. Further blade housing 66 may also include pedestal mounts 67 which are lined within an inner surface of blade housing 66. In one embodiment, the number of pedestal mounts 67 provided corresponds to the number of protruding arms which extend outwardly from pedestal 24. The protruding arms engage with pedestal mounts 67 thereby allowing for rotor assembly 20 to be safely secured to housing assembly 60. Once assembled, housing assembly 60 is configured to be easily mounted onto an existing air duct as seen in FIG. 1 of the provided drawings. The disclosed structure allows for the system 10 to be easily implemented into an existing air duct system without the need for any major structural modifications to the current system.

Housing assembly 60 may also include an optional brake mechanism 68 which may be implemented onto the system. In the present embodiment, brake mechanism 68 is a stop brake mechanism which is configured to engage with the gear system in order to terminate the oscillating motion supplied by rotor assembly 20. As observed in FIG. 3, brake mechanism 68 is inserted through blade housing 66 to be selectively coupled to rotor assembly 20. Blade mechanism 68 may further include an operative handle which is fed through the slit 64 and accessed through the front end of frame portion 62. The operative handle allows for a user to actuate the braking mechanism 68. When actuated, braking mechanism 68 engages with splined shaft 29 of the gear system to halt oscillating motion thereby halting the periodic adjusting of venting panels 21. Additionally, braking mechanism 68 may also be disengaged to reenable the periodic motion of venting panels 21.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A dynamic register system, comprising:

a) a rotor assembly including a fan blade being coupled to a pedestal through a shaft, pedestal includes protruding arm members and a rectangular portion, said rectangular portion having a central opening which receives said shaft, said protruding arms are vertically disposed in the four corners of said rectangular portion, wherein said shaft is operatively engaged to a gear system having at least two gears, said gear system delivering an oscillating rotational motion when said fan blade is actuated, wherein a first bushing is positioned between said fan blade and said pedestal, said rectangular portion and said protruding arm members have pedestal openings, wherein pedestal openings are placed in the four corners of said rectangular portion and in the distal ends of said protruding arm members;

b) a vent assembly including a plurality of venting panels having guide rulers and mobility rulers coupled to lateral side ends thereof, said venting panels are rectangular vent structures which are positioned parallel to each other, wherein said guide rulers are stationary rulers, said venting panels being rotatably mounted to said guide rulers, wherein said mobility rulers are non-stationary rulers having a length that is less than a length of said guide rulers, wherein said guide rulers are parallel to said mobility rulers, said mobility rulers including an axle mounting portion, wherein said mobility rulers support a first axle by mounting said first axle to said axle mounting portion, an adapter member, wherein a distal end of said adapter member engages with said first axle wherein a proximal end of said adapter member is coupled to said gear system, wherein a second axle is engaged to a central portion of said adapter member, wherein said second axle is an stationary axle, wherein said adapter member said guide rulers and mobility rulers are parallel to said pedestal, wherein said rotational motion of said gear system results in a vertically oscillating motion of said mobility rulers to then periodically adjust a position of said venting panels from an opened configuration to a closed configuration, wherein said mobility rulers and said guide rulers are substantially perpendicular to said venting panels in said opened configuration, wherein said lateral ends of said venting panels include protruding elements, said protruding elements are inserted in openings of said guide rulers and said mobility rulers, wherein said gear system is housed within a casing, said casing receiving said shaft therethrough to be operatively engaged to the gear system, wherein a second bushing is positioned between said pedestal and said casing; and c) a housing assembly, said housing assembly including a frame portion and a back portion being coupled together to nest said rotor assembly and said vent assembly therein, said frame portion is a rectangular frame portion that receives said vent assembly therein, said frame portion including a slit located along a side edge of said frame portion, said frame portion including apertures, said apertures are configured to receive screw members to couple said frame portion to said back portion, said apertures are along four corner ends of a back end of said frame portion, said frame portion having an opening to expose said venting panels, wherein said pedestal openings are capable of being used to secure said pedestal to said housing assembly by introducing screws therethrough.

2. The dynamic register system of claim 1 wherein each of said protruding arm members include a mounting member on a distal most end, said mounting member is adapted to mount said pedestal to said back portion.

3. The dynamic register system of claim 1 wherein said gear system includes a first and second gear, said shaft engaging with said first gear, said first gear including a spline shaft extending perpendicularly therefrom, a handle that is operatively connected to the second gear, wherein a distal end of said handle is configured to rotate 360 degrees, wherein a cam is positioned between said handle and said second gear, said handle being coupled to said adapter member to deliver rotational oscillating motion from said gear system, wherein said handle is operatively connected to a slit portion, said slit portion is an elongated opening positioned extending along a distal end of said adapter member.

4. The dynamic register system of claim 1 wherein said adapter member includes a forked portion, and an axle receiving section, said axle receiving section having a support axle mounted therethrough.

5. The dynamic register system of claim 4 wherein said forked portion located on a proximal end of said adapter member, said forked portion engaging with said at least one axle of said mobility rulers.

6. The dynamic register system of claim 1 wherein said back portion includes a blade housing having a cylindrical shape, said blade housing supporting said rotor assembly therein.

7. The dynamic register system of claim 6 wherein said blade housing includes pedestal mounts within an inner surface, said protruding arms engage with said pedestal mounts.

8. The dynamic register system of claim 1 further includes a brake mechanism which engages with said gear system.

9. The dynamic register system of claim 1 wherein said housing assembly is mounted onto an air duct which is delivering air therein.

10. The dynamic register system of claim 1 wherein one of the said at least two gears is a worm wheel, wherein said shaft is a worm shaft which perpendicularly engages the worm wheel to form a worm gear system.

11. A dynamic register system, consisting of:

a) a rotor assembly including a fan blade being coupled to a pedestal through a shaft, wherein said shaft is operatively engaged to a gear system housed with a casing having a first gear and a second gear, a handle being mounted to the second gear of the gear system, wherein said handle engages in a rotational motion when said fan blade is actuated, wherein a bushing is positioned between said fan blade and said pedestal;

b) a vent assembly including venting panels having guide rulers and mobility rulers coupled to lateral side ends thereof, wherein said venting panels are rectangular vent structures which are positioned parallel to each other, said mobility rulers are non-stationary rulers having a length that is less than a length of said guide rulers, wherein said guide rulers are parallel to said mobility rulers, said mobility rulers including an axle mounting portion, wherein said mobility rulers support a first axle by mounting said first axle to said axle mounting portion, said vent assembly including an adapter member, wherein a distal end of said adapter member engages with said first axle, wherein a proximal end of said adapter member is coupled to said gear system, wherein a second axle is engaged to a central portion of said adapter member, wherein said second axle is an stationary axle, wherein said adapter member, said guide rulers and mobility rulers are parallel to said pedestal, wherein said rotational motion of said gear system results in a vertically oscillating motion of said mobility rulers to then periodically adjust a position of said venting panels from an open configuration to a close configuration, wherein said mobility rulers and said guide rulers are substantially perpendicular to said venting panels in said open configuration, wherein said lateral ends of said venting panels include protruding elements, said protruding elements are inserted in openings of said guide rulers and said mobility rulers, wherein said gear system is housed within a casing, said casing receiving said shaft therethrough to be operatively engaged to the gear system; and c) a housing assembly including a frame portion and a back portion joined together to nest said rotor assembly and said vent assembly therein, said frame portion is a rectangular frame portion that receives said vent assembly therein, said frame portion including a slit located along a side edge of said frame portion, said housing assembly being mounted to an air duct, wherein said fan blade is actuated by air being delivered through said air duct, said frame portion including apertures, said apertures are configured to receive screw members to couple said frame portion to said back portion, said apertures are along four corner ends of a back end of said frame portion, said frame portion having an opening to expose said venting panels.

* * * * *